US005865508A

United States Patent [19]

Martin

[11] Patent Number: 5,865,508

[45] Date of Patent: Feb. 2, 1999

[54] INTEGRATED SEAT FRAME AND BACK SUPPORT

[75] Inventor: Leo Martin, Coconut Grove, Fla.

[73] Assignee: Miami Metal Products, Inc.

[21] Appl. No.: 865,873

[22] Filed: May 30, 1997

[51] Int. Cl.[6] ..... A47C 7/02

[52] U.S. Cl. ..... 297/451.1; 297/440.15

[58] Field of Search ..... 297/383, 440.15, 297/445.1, 451.1, 452.18

[56] References Cited

U.S. PATENT DOCUMENTS

| | | | |
|---|---|---|---|
| 2,800,171 | 7/1957 | Hoven et al. | 297/451.1 |
| 3,000,669 | 9/1961 | Silverman | 297/451.1 |
| 3,111,344 | 11/1963 | Hoven et al. | 297/451.1 X |
| 4,946,224 | 8/1990 | Leib | 297/451.1 |

FOREIGN PATENT DOCUMENTS

| | | | |
|---|---|---|---|
| 1253296 | 1/1961 | France | 297/440.15 |
| 322932 | 8/1957 | Switzerland | 297/451.1 |

*Primary Examiner*—Peter H. Brown

[57] ABSTRACT

An integrated seating device comprises a seat frame having a front end and a rear end. The seat frame has a double wall defining an exterior wall and an interior wall. The rear end of the seat frame has a slot cut therethrough both the exterior wall and the interior wall. The front end of the seat frame has a slot cut through just the interior wall thereof. A back support comprising a generally L shape has a horizontal member, and a generally vertical member which is substantially perpendicular to the horizontal member. The horizontal member is sized to be threaded through the rear slot and is fitted into the front slot. Welded slat means secures the back support to the seat frame to result in an integrated seating device.

6 Claims, 2 Drawing Sheets

INTEGRATED SEAT FRAME AND BACK SUPPORT

FIELD OF THE INVENTION

The present invention comprises a novel seating device. More particularly, the novel seating device comprises an integrated seat frame and back support which provides a more integral and structurally sound seating device.

BACKGROUND OF THE INVENTION

Heretofore, seating devices comprised a multitude of structures constructed for their intended purpose. A myriad of construction methods have been utilized to achieve the final end product of these seating devices. Typically, the prior art consists of either a one piece structure that incorporates a seat frame and a back support, or a multiple piece structure that requires means for attachment of said components. The attachment means oftentimes is nut and bolt assemblies, screws, wood glue, and the like.

In relying upon these attachment means, the structure of the respective seating devices are subject to breakage or collapse. Heretofore, a seating device has never incorporated structure to integrate a multiple component seating device comprising generally a seat frame and a back support, thus avoiding attachment means above discussed.

SUMMARY OF THE INVENTION

The present invention overcomes the disadvantages of the prior art by disclosing and teaching a novel seating device comprising an integrated seating assembly having generally a seat frame and a back support. An integrated seating device comprises a seat frame having a front end and a rear end. The seat frame has a double wall defining an exterior wall and an interior wall. The rear end of the seat frame has a slot cut therethrough both the exterior wall and the interior wall. The front end of the seat frame has a slot cut through just the interior wall thereof. A back support comprising a generally L shape has a horizontal member, and a generally vertical member which is substantially perpendicular to the horizontal member. The horizontal member is sized to be threaded through the rear slot and is fitted into the front slot. Welded slat means secures the back support to the seat frame to result in an integrated seating device.

Accordingly, an advantage of the present invention is to provide an integrated seat frame and back support. The integration results in a more structurally sound back support member that is less likely to break off or separate from the seat frame member.

It is another object of the present invention to provide and integrated seat frame and back support such that a lumbar supportive component may be added to the back support to provide for lumbar support for a human user of the seating device.

It is still another object of the present invention to provide an integrated seat frame and back support that permits the back support to flex under the weight of a user who might lean backward to achieve a comfortable sitting position.

BRIEF DESCRIPTION OF THE DRAWINGS

The features embodying the present invention are illustrated in the accompanying drawings, forming a part of this application, in which.

DETAILED DESCRIPTION OF A PREFERRED EMBODIMENT

Figure 2:
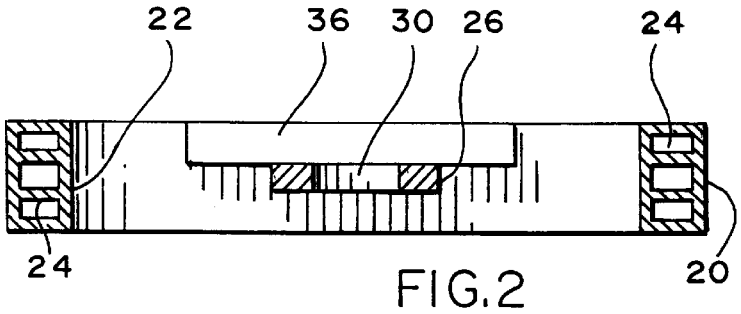
FIG. 2 is a cross section view taken along line 2—2 of FIG. 1.
Figure 1:
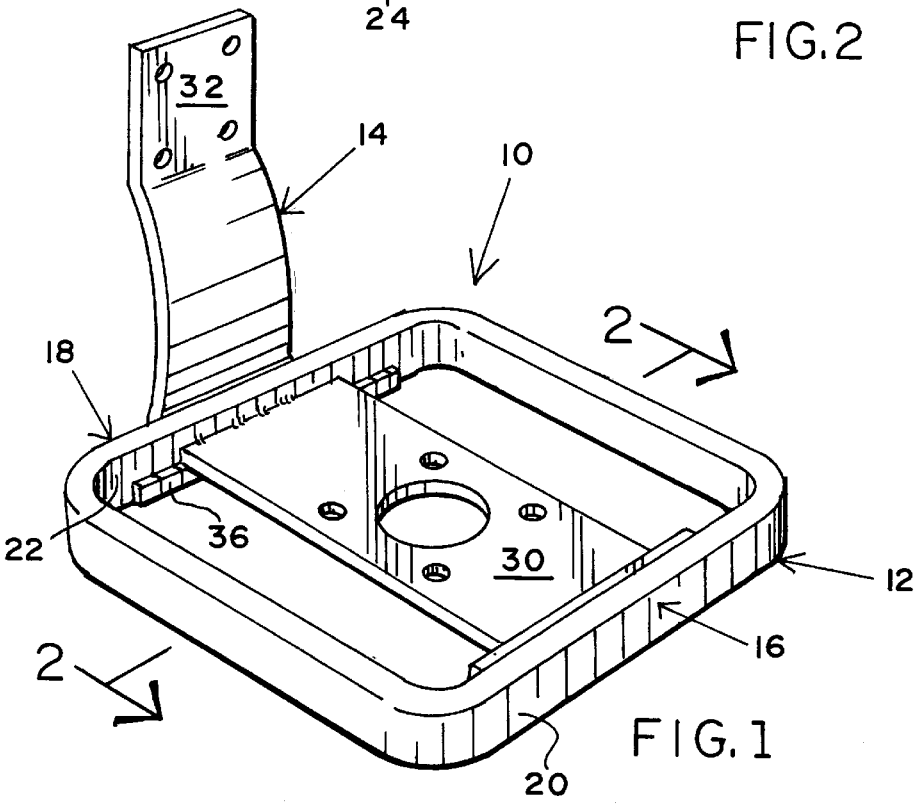
FIG. 1 is a perspective view of the present invention.

FIG. 1 depicts an integrated seating device 10 of the present invention. The seating device 10 comprises a seat frame member 12 and a back support member 14. The seat frame 12 is formed to be used as the human support member for the seating device 10. As such, the seat frame 12 is sized to support the weight of a human user. As shown in FIG. 1, therefore, seat frame 12 has a generally squarish dimension, though any seating dimension may be used. The seat frame 12 depicted has a front end 16 and a rear end 18.

Seat frame 12, as shown in FIGS. 1, 1A, 1B, 2 and 3 has two walls—an exterior wall 20 and an interior wall 22. This double wall is a preferred embodiment though the frame 12 can have more than two walls. Furthermore, as shown, the seat frame 12 is formed of a metal extrusion, for example, aluminum. Transverse ribs 24 may be added to the extrusion to support the integrity of the double wall assembly.

Figure 1A:
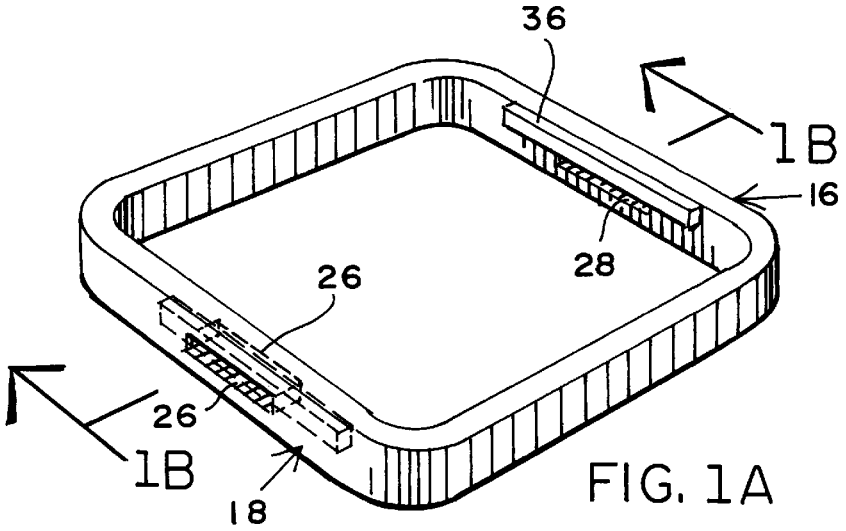
FIG. 1A is a perspective view of the present invention shown without the back support member.
Figure 1B:
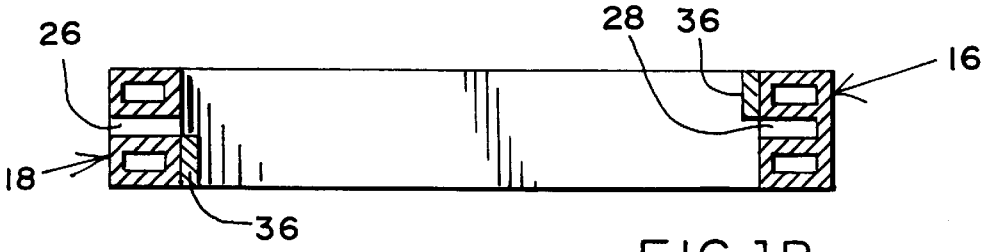
FIG. 1B is a cross section view taken along line 1–B of FIG. 1A.

Referring to FIGS. 1A and 1B, a rear slot 26 is cut completely through both the exterior wall 20 and the interior wall 22 at the rear end 18 of seat frame 12. The rear slot 26 is sized to permit a component of the back support 14 to be threaded therethrough as hereinbelow discussed. A front slot 28 is cut through the interior wall 22 at the front end 16 of seat frame. The front slot 28 is configured to permit the same component of the back support 14 to be threaded and abutted therethrough. The exterior wall 20 of the front end 16 is not slotted.

Back support 14 has a general "L" shape which is comprised of a horizontal member 30, and a perpendicular vertical member 32. The back support as shown is one piece and is made of a metal, though any suitable material may be used. Additionally, back support 14 may be manufactured of more than one piece if desired.

It is intended that the slots, 26 and 28, be configured to accommodate the cross sectional dimension of the horizontal member 30 of back support 14. Thus, the cross section of horizontal member 30 should reasonably relate to the cross section of slots 26 and 28. However, it is not necessary that slots 26 and 28 accommodate the cross section of the horizontal member 30 in a matable relationship so long as the slots' dimensions are sized to permit the horizontal member 30 to be threaded therethrough.

Figure 3:
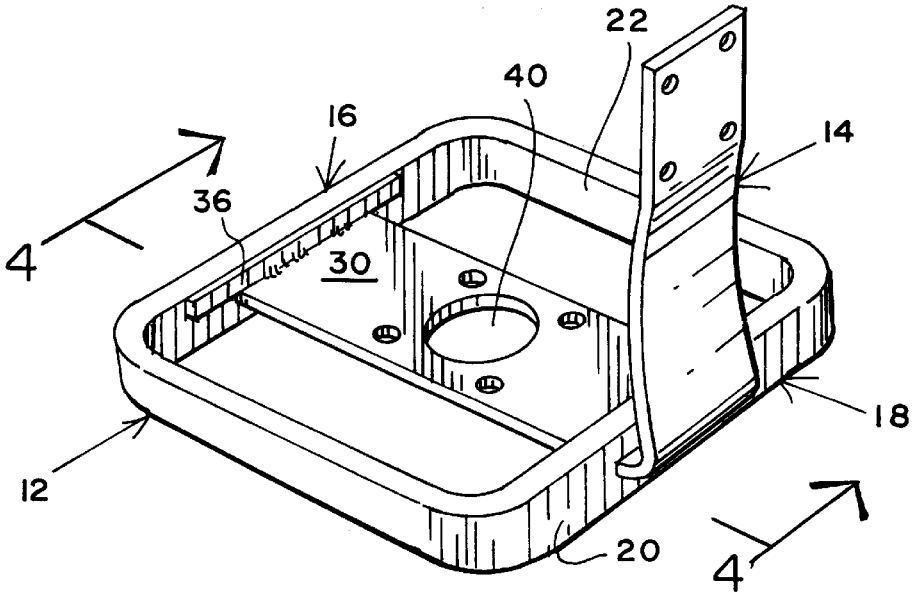
FIG. 3 is a perspective view of the present invention.
Figure 4:
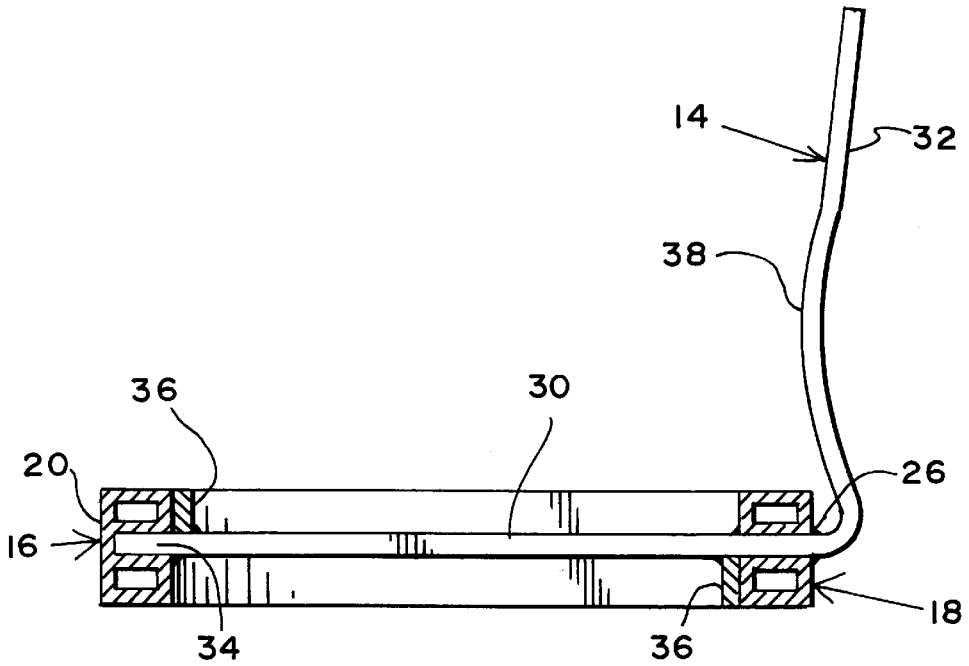
FIG. 4 is cross section view taken along line 4—4 of FIG. 3.

In construction, the horizontal member 30 of back support is threaded through the rear slot 26 of seat frame 12 as seen in FIGS. 1, 3 and 4. The forward-most edge 34 of the horizontal member 30 is guided into the front slot 28 on the interior wall 22 at the front end 16 of seat frame 12. Slats 36 are welded to the interior wall 22, below the rear slot 26 and above the front slot 28, and to the horizontal member 30, to secure the back support 14 to the seat frame 12. Other conventionally known securement means may be employed with the seat frame and/or back support when those components, or the slats, are not constructed of metal. As shown in FIG. 4, a convex lumbar bend 38 can be added to the vertical member 32 of back support 14 to enhance the comfort of the seating device. Hole means 40 to allow the seating device 10 to be secured to a seating base member (not shown) may be provided.

It is intended that the description of the preferred embodiments of this invention is illustrative only. Other embodiments of the invention that are within the scope and concept of this invention are herein included within this application.

What is claimed is:

1. A seating device comprising a seat frame member having sidewalls, a front end and a rear end such that each of the front and rear ends comprises exterior and interior walls, a rear slot located at the said rear end and a front slot located at the said front end, said rear slot being formed by a complete cut through the said walls and said front slot being formed by a cut through said interior wall only, and a back support member comprising a generally horizontal member attached at a first end to a perpendicular vertical member, said horizontal member having a second end comprising a cross section that is sized to be threaded through said rear slot and into said front slot, and means for securing said back support to said seating device comprising at least one slat affixed to the interior wall of said front end and to the horizontal member of said back support.

2. A seating device of claim 1 formed of metal.

3. A seating device of claim 2, where said seat frame is formed of extruded metal.

4. A seating device comprising a seat frame member having sidewalls, a front end and a rear end such that each of the front and rear ends comprises exterior and interior walls, a rear slot located at the said rear end and a front slot located at the said front end, said rear slot being formed by a complete cut through the said walls and said front slot being formed by a cut through said interior wall only, and a back support member comprising a generally horizontal member attached at a first end to a perpendicular vertical member, said horizontal member having a second end comprising a cross section that is sized to be threaded through said rear slot and into said front slot, and means for securing said back support to said seating device comprising at least one slat affixed to the interior wall of said front end and to the second end of said horizontal member, and at least one slat affixed to the interior wall of the rear end and to the first end of the said horizontal member.

5. A seating device of claim 4 formed of metal.

6. A seating device of claim 5, where said seat frame is formed of extruded metal.

* * * * *